US011751708B2

(12) United States Patent
Wu

(10) Patent No.: US 11,751,708 B2
(45) Date of Patent: Sep. 12, 2023

(54) ARTICLE STORAGE AND RETRIEVAL APPARATUS

(71) Applicant: BEIJING JINGDONG ZHENSHI INFORMATION TECHNOLOGY CO., LTD., Beijing (CN)

(72) Inventor: Mingfu Wu, Beijing (CN)

(73) Assignee: BEIJING JINGDONG ZHENSHI INFORMATION TECHNOLOGY CO., LTD., Beijing (CN)

( * ) Notice: Subject to any disclaimer, the term of this patent is extended or adjusted under 35 U.S.C. 154(b) by 344 days.

(21) Appl. No.: 17/262,003

(22) PCT Filed: Jul. 29, 2019

(86) PCT No.: PCT/CN2019/098179
§ 371 (c)(1),
(2) Date: Jan. 21, 2021

(87) PCT Pub. No.: WO2020/024900
PCT Pub. Date: Feb. 6, 2020

(65) Prior Publication Data

US 2021/0307550 A1 Oct. 7, 2021

(30) Foreign Application Priority Data

Aug. 3, 2018 (CN) ..... 201810877391.3

(51) Int. Cl.
*A47G 29/14* (2006.01)
*A47G 29/22* (2006.01)
(Continued)

(52) U.S. Cl.
CPC ..... *A47G 29/141* (2013.01); *A47G 29/20* (2013.01); *A47G 29/22* (2013.01); *A47G 29/30* (2013.01); *A47G 2200/106* (2013.01)

(58) Field of Classification Search
CPC ..... A47G 29/141; A47G 29/20; A47G 29/22; A47G 29/30; A47G 29/00; A47G 29/12;
(Continued)

(56) References Cited

U.S. PATENT DOCUMENTS 452,071 A * 5/1891 Deeves ..... A47G 29/12 232/38
2,456,479 A * 12/1948 Antil ..... B65D 9/14 312/258
(Continued)

FOREIGN PATENT DOCUMENTS

CN 105411340 A 3/2016
CN 107518751 A 12/2017
(Continued)

OTHER PUBLICATIONS

International Search Report dated Nov. 4, 2019 in PCT/CN2019/098179 filed on Jul. 29, 2019, 2 pages.

*Primary Examiner* — William L Miller
(74) *Attorney, Agent, or Firm* — Oblon, McClelland, Maier & Neustadt, L.L.P.

(57) ABSTRACT

The present disclosure relates to an article storage and retrieval apparatus, including a frame body, configured to be fixed on a vertical mounting surface; a cover body, the cover body hinged with the frame body at upper end, left end or right end to realize rotary opening and closing; and a container, an open end of the container being arranged on an inner side of the cover body and the container being located in a space formed between the frame body and the cover body, wherein the container has a variable volume and is configured to be unfolded to form a space for accommodating articles after the cover body is opened relative to the frame body and allow the cover body to be closed relative to the frame body after being folded.

18 Claims, 5 Drawing Sheets

(51) Int. Cl.
*A47G 29/30* (2006.01)
*A47G 29/20* (2006.01)

(58) Field of Classification Search
CPC ..... A47G 29/122; A47G 2029/146; A47G 2200/106; B65D 7/26; B65D 9/14; B65D 11/1853; B65D 15/24; B65D 21/086
USPC ..... 232/19, 38, 45; 220/6, 666
See application file for complete search history.

(56) References Cited

U.S. PATENT DOCUMENTS

| | | | | |
|---|---|---|---|---|
| 6,426,699 | B1 * | 7/2002 | Porter | A47F 10/00 340/568.1 |
| 9,861,221 | B2 | 1/2018 | Jiang | |
| 10,321,780 | B1 * | 6/2019 | James | A47G 29/141 |
| 10,537,196 | B1 * | 1/2020 | MacPherson | A47G 29/141 |
| 10,709,276 | B2 * | 7/2020 | Guanch | A47G 29/20 |
| 10,743,694 | B2 * | 8/2020 | Raphael | A47G 29/141 |
| 10,743,695 | B1 * | 8/2020 | Altmaier | B60R 9/065 |
| 10,786,103 | B2 * | 9/2020 | Teoh | B65D 11/1853 |
| 11,197,566 | B2 * | 12/2021 | Aresu | A47G 29/124 |
| 11,246,443 | B2 * | 2/2022 | Lin | A47G 29/141 |
| 11,406,212 | B2 * | 8/2022 | Odeh | A47G 29/141 |
| 11,510,517 | B2 * | 11/2022 | McLean | B65D 11/1853 |
| 2016/0331171 | A1 | 11/2016 | Jiang | |
| 2018/0125278 | A1 | 5/2018 | Jiang | |
| 2019/0225375 | A1 * | 7/2019 | Sena | A47G 29/20 |
| 2020/0046155 | A1 * | 2/2020 | Aresu | A47G 29/12 |
| 2021/0228013 | A1 * | 7/2021 | Zhang | A47G 29/141 |
| 2022/0267048 | A1 * | 8/2022 | Rogers | A47G 29/141 |
| 2022/0346583 | A1 * | 11/2022 | Evangelidis | A47G 29/20 |

FOREIGN PATENT DOCUMENTS

| | | | |
|---|---|---|---|
| CN | 107735001 | A | 2/2018 |
| JP | 8-733 | U | 4/1996 |
| JP | 10-117917 | A | 5/1998 |
| WO | WO 2016/182595 | A1 | 11/2016 |
| WO | WO 2018/032310 | A1 | 2/2018 |

* cited by examiner

ARTICLE STORAGE AND RETRIEVAL APPARATUS

CROSS-REFERENCE TO RELATED APPLICATION

The present application is a National Stage of International Application No. PCT/CN2019/098179 filed on Jul. 29, 2019, which claims the priority of the Chinese patent application No. 201810877391.3, entitled "ARTICLE STORAGE AND RETRIEVAL APPARATUS" and filed on Aug. 3, 2018, both of which are incorporated herein by reference in their entireties.

FIELD OF THE DISCLOSURE

The present disclosure relates to an article storage and retrieval apparatus.

BACKGROUND OF THE DISCLOSURE

With the rise of online shopping and logistics industry, the number of express delivery orders has increased rapidly year by year. People need to wait for the courier at home when receiving and sending a package, and the door-to-door time of the courier cannot be accurately controlled at present, which inevitably coincides with the time when the customer is not at home. When the customer is not at home, the courier has to come again at another time, or deliver the package to the neighbors for collection, directly place it at the door or small shops nearby and other methods and the like with safety risk.

For the courier, when there is no one in the customer's home, it will consume a lot of time cost and reduce efficiency by changing the delivery time; however, there are safety risks such as package loss by changing the collection way.

For the customer, it is difficulty to ensue that there is someone at home when the courier arrives. When the customer needs to go out, it is a very bad shopping experience to worry about when the courier will come to the door, reconfirm the door-to-door time with the courier and whether the package will be lost in the storage place.

SUMMARY OF THE DISCLOSURE

The embodiment of the present disclosure provides an article storage and retrieval apparatus, including:

a frame body, configured to be fixed on a vertical mounting surface;

a cover body, hinged with the frame body at upper end, left end or right end to rotate to open and close; and a container, an open end of the container being arranged on an inner side of the cover body and the container being located in a space formed between the frame body and the cover body, wherein the container has a variable volume and is configured to be unfolded to form a space for accommodating articles after the cover body is opened relative to the frame body and allow the cover body to be closed relative to the frame body after being folded.

In some embodiments, the article storage and retrieval apparatus further includes a cap body arranged on the cover body corresponding to the open end of the container; and the cap body is arranged in an openable and closeable manner relative to the cover body to expose the open end of the container after being opened and close the open end of the container after being closed.

In some embodiments, when the cover body is closed, an upper end of the cap body is hinged to the cover body, and a lower end of the cap body is openable and closeable through rotation relative to the cover body.

In some embodiments, the article storage and retrieval apparatus further includes:

a first locking component, arranged between the cap body and the cover body to lock the cap body relative to the cover body; and an identity recognition component, configured to unlock the first locking component after identity verification information provided by a user is verified successfully.

In some embodiment, a spring mechanism is arranged between the cap body and the cover body for bouncing the cap body off after the first locking component is unlocked.

In some embodiments, the article storage and retrieval apparatus further includes:

a supporting mechanism, adopting a telescopic structure, wherein the supporting mechanism is connected to the frame body to extend out after the container is unfolded to provide support for the bottom of the container.

In some embodiments, the supporting mechanism adopts a scissor-shaped structure; and one end of the scissor-shaped structure is connected to a bottom area of the frame body and the other end of the scissor-shaped structure is a free end.

In some embodiments, the article storage and retrieval apparatus further includes:

a position retaining part, arranged between the flame body and the cover body and adopting a telescopic structure to retain a position of the cover body after the cover body is opened relative to the frame body.

In some embodiments, the position retaining part is a nitrogen spring.

In some embodiments, one side, facing the cover body, of the frame body is provided with a cavity, and the container is located in the cavity after being folded.

In some embodiments, the article storage and retrieval apparatus further includes a magnet, wherein the magnet is arranged on the frame body or the cover body to prevent the cover body from swinging outwards after the cover body is closed, and the magnet is covered with a rubber layer for buffering when the cover body is closed.

In son embodiments, the container is a flexible container.

In some embodiments, a plurality of first supporting rings and a plurality of second supporting rings are arranged on the container, the plurality of first supporting rings and the plurality of second supporting rings are alternately arranged at intervals along a height direction of the container, and an area surrounded by the first supporting rings is greater than that of the second supporting rings; and the article storage and retrieval apparatus further includes a traction part, and the traction part is connected to the plurality of first supporting rings sequentially along the height direction of the container so as to move to fold the container when a free end of the traction part is subjected to an external pulling force.

In some embodiments, a guide component and a fixed part are arranged on the cover body, the traction part is guided by the guide component in the moving process, and the free end of the traction part can be connected to the fixed part after the container is folded in place.

In some embodiments, the guide component includes a plurality of pulley blocks, a mounting frame is arranged in the cover body, the open end of the container is connected to the mounting frame, the plurality of pulley blocks are arranged on an outer side wall of the mounting frame at intervals along a circumferential direction, the fixed part is arranged in an area surrounded by the mounting frame, and after the traction part goes around at least part of the pulley blocks, the free end of the traction part can be connected to the fixed part when the container is folded in place.

In some embodiments, the container is a foldable accommodating box, and the accommodating box includes a plurality of plates.

In some embodiments, a plurality of plates include:

two first plates, arranged oppositely, a first end of each of the two first plates being connected to the cover body;

a second plate, located between the two first plates and connected to second ends, away from the first ends, of the two first plates; and two third plates, a first end of each of the two third plates being respectively connected to two opposite ends of the second plate, a second end of each of the third plates being able to turn over relative to the second plate to unfold or fold the accommodating box, and a second locking component being arranged between the second end of each of the two third plates and the cover body, wherein an opening of the accommodating box is surrounded by the first end of each of the two first plates and the second end of each of the two third plates, each of the two first plate is provided with a folding line extending parallel to the second plate at a middle position vertical to the second plate, and a connection position of the adjacent plates is also provided with the folding line.

In some embodiments, the article storage and retrieval apparatus further includes a supporting mechanism, wherein the supporting mechanism adopts a telescopic structure and arranged in the frame body to extend out after the container is unfolded to provide support for the bottom of the container; and the article storage and retrieval apparatus further includes a controller, configured to, in response to an external trigger signal, execute at least one of the following actions: opening and closing of the cover body, opening and closing of the cap body, extension and retraction of the supporting mechanism and folding of the container.

In some embodiments, the article storage and retrieval apparatus is an express box.

BRIEF DESCRIPTION OF THE ACCOMPANYING DRAWINGS

The accompanying drawings described herein are used to provide further understanding of the present disclosure and constitute a part of the present application. The schematic embodiments of the present disclosure and the description thereof are used to explain the present disclosure, but do not constitute an inappropriate limitation to the present disclosure. In the accompanying drawings.

DETAILED DESCRIPTION OF THE PREFERRED EMBODIMENTS

Figure 1:
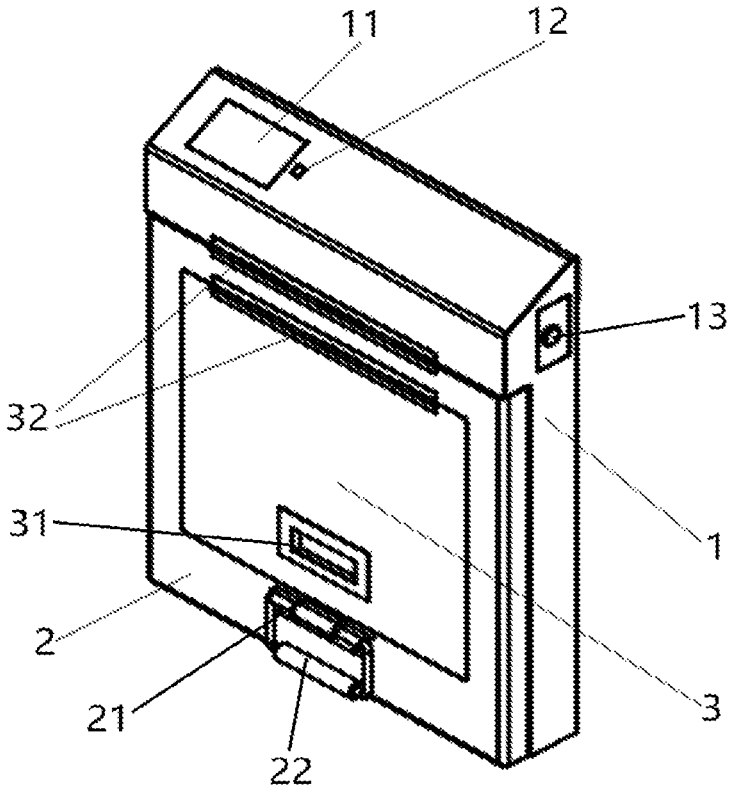
FIG. 1 is a schematic structural diagram of some embodiments of an article storage and retrieval apparatus according to the present disclosure in a closed state.

The present disclosure is described hereinafter in detail. In the following paragraphs, different aspects of embodiments are defined in detail. The aspects defined may be combined with one or more of any other aspects unless it is explicitly pointed that they cannot be combined. In particular, any features considered to be preferred or favorable may be combined with one or more of other features considered to be preferred or combination favorable.

The terms "first", "second" and the like appearing in the present disclosure are only used to facilitate description so as to distinguish different components with the same name, but not to represent a sequence or a primary and secondary relationship.

In the description of the present disclosure, it should be understood that an azimuth or position relationship indicated by terms "upper", "lower". "top", "bottom", "front". "rear", "inner" and "outer" and the like is an azimuth or position relationship based on the accompanying draws, which is only for convenient description of the present disclosure, but not indicates or implies that the referred device must have a specific azimuth and perform construction and operation in the specific azimuth; therefore, it cannot be interpreted as a limitation to the protection scope of the present disclosure. In the following description, one side, facing the mounting surface, of the article storage and retrieval apparatus is defined as the rear, and other directions are defined based on this.

The embodiment of the present disclosure provides an article storage and retrieval apparatus, which can improve the article storage and retrieval convenience.

Based on the above technical solutions, the article storage and retrieval apparatus according to some embodiments of the present disclosure is arranged at a position convenient for a user to take and place articles, a container with a variable volume is arranged between the cover body and the frame body, and the container is unfolded to form a space for accommodating articles after the cover body is opened relative to the frame body, and allows the cover body to be closed relative to the frame body after being folded. By adoption of the article storage and retrieval apparatus, articles may be stored and taken more conveniently and waiting time may be saved; moreover, the foldable container is provided, so that the article storage and retrieval apparatus may be folded when not being used, occupied space may be reduced and the overall structure is simple.

As shown in FIG. 1 to FIG. 6, the present disclosure provides an article storage and retrieval apparatus. In some embodiments, the article storage and retrieval apparatus includes a frame body 1, a cover body 2 and a container 6. The frame body 1 is configured to be fixed on a vertical mounting surface. The vertical mounting surface mentioned here includes a vertical surface at 90° with a horizontal surface, and a mounting surface with a preset range of angle deviation from the vertical surface. For example, the article storage and retrieval apparatus may be fixed at a position convenient for a specific user to take and place articles. For home users, the mounting surface may be arranged near the user's house, corridor or entrance. For company users, the mounting surface may be arranged near the door of the company.

Figure 2:
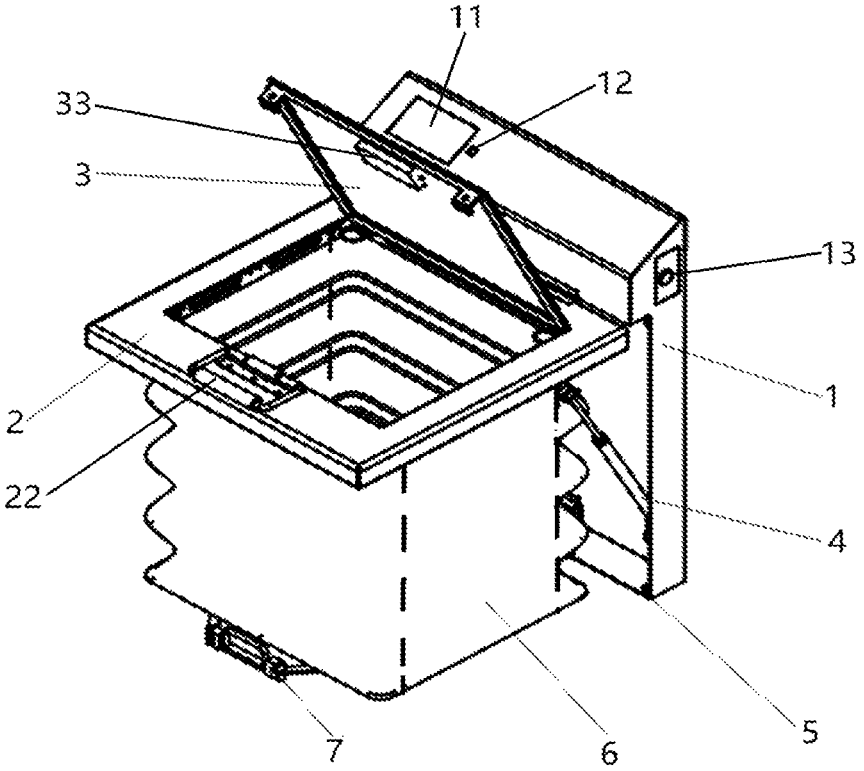
FIG. 2 is a schematic structural diagram of some embodiments of an article storage and retrieval apparatus according to the present disclosure in an open state.

The cover body 2 and the frame body 1 are hinged at upper end, left end or right end to realize rotary opening and closing. An open end of the container 6 is arranged on an inner wall of the cover body 2 and is located in a space formed between the frame body 1 and the cover body 2. The container 6 has a variable volume and is configured to be unfolded after the cover body 2 is opened relative to the frame body 1 to form a space for accommodating articles so as to put the articles; and the container 6 is folded after the articles are taken out so as to allow the cover body 2 to be closed relative to the frame body 1. FIG. 1 is a schematic diagram of a cover body 2 in a closed state, and FIG. 2 is a schematic diagram of a cover body 2 in a completely open state.

The article storage and retrieval apparatus according to the embodiments of the present disclosure at least has one of the following advantages:

(1) the articles can be stored and taken more conveniently, the deliverer and the picker are connected more smoothly, use is facilitated, waiting time may be saved, and the article storage and retrieval efficiency is improved.

(2) The container 6 has a variable volume, and can form a space for accommodating the articles after being unfolded and can be folded after the articles are taken out or in a state where no articles are placed. The structure not only can meet the functional requirement of putting express packages, but also can reduce the occupied space of the article storage and retrieval apparatus in a non-use state.

(3) The cover body 2 and the frame body 1 are hinged at the upper end, left end or right end to realize rotary opening and closing, and the user applies an action force to controllably open the cover body 2 under the action of an external force after the article storage and retrieval apparatus is unlocked, so that the cover body cannot be unfolded freely under the action of the gravity to avoid a large impact force, thus improving the stability when the article storage and retrieval apparatus is opened, reducing the impact of the container 6 when being unfolded and prolonging the service life of the article storage and retrieval apparatus.

In some embodiments, to fold the container 6, the container 6 adopts a flexible material and may be folded by an operator through any folding modes. The flexible container 6 facilitates change of the volume, so that the volume changing process is faster; and the container 6 is easily designed into an overall article storage space, so that the operating method for changing the volume may be simplified, the express storage and retrieval efficiency is improved, the express is not liable to damage after long-term use, and the precision requirement of the related mechanism for changing the volume can be reduced.

Figure 4:
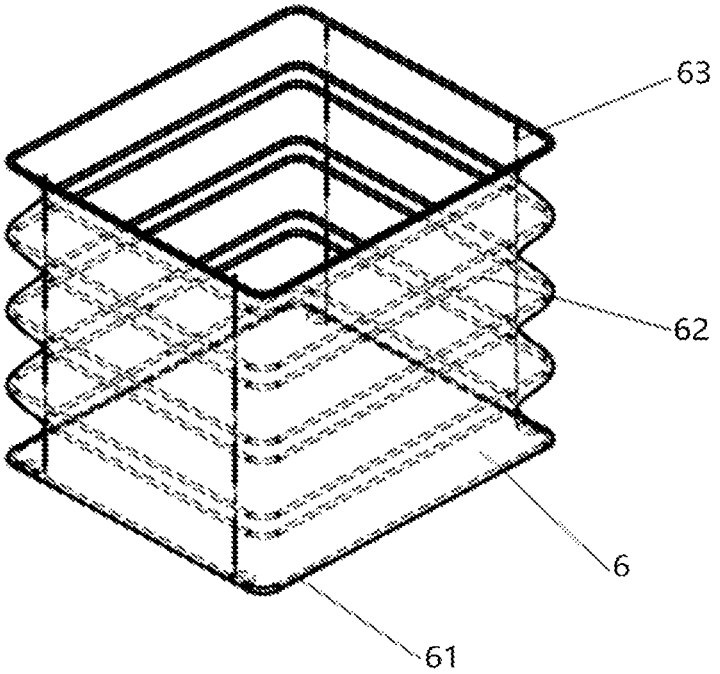
FIG. 4 is a schematic structural diagram of some embodiments of a container in an article storage and retrieval apparatus according to the present disclosure.

In some embodiments, as shown in FIG. 4, to enable the container 6 to be folded regularly, a hard supporting framework may be arranged on the container 6, so that container 6 is folded in a preset manner. For example, the container 6 may adopt an anti-cutting material so as to prevent others from cutting the container 6 to take the express, thus improving the express storage safety.

In some embodiments, to fold the container 6, the container is a foldable accommodating box, and the accommodating box is formed by a plurality of plates, so that the volume may be changed through folding of each plate. The accommodating box may adopt a hard material, such as a plastic plate or a metal plate, etc., so that the overall strength is high and the article can be supported more stably.

In an application scenario, the article storage and retrieval apparatus is an express box, correspondingly, the article is an express. The express box may be used by specific users and related couriers and the container 6 is unfolded after the cover body 2 is opened relative to the frame body 1 to form a space for accommodating articles, so that it is convenient for a deliverer to put the express in the container 6; and the container 6 is folded after a picker takes out the express to close the cover body 2 relative to the frame body 1, thus reducing the occupied space of the express box in a non-use state.

Compared with the shared express cabinet, the express box is simple in structure and small in volume, may flexibly adapt to the needs of the user for sending and receiving express and online shopping, and is more convenient for the user to receive and send the express, thereby improving the convenience for the deliverer or the picker to store and take the express. In different usage scenarios, the deliverer and the picker correspond to one role of the courier and the user respectively.

The article storage and retrieval apparatus may be used by the courier for delivery and by the user for retrieving the express, so that when the delivery time of the courier and the receiving time of the user cannot be matched with each other, the delivery time may be saved, the delivery efficiency may be improved, and the safety of temporary express storage is improved; moreover, the article storage and retrieval apparatus may be used by the user for sending articles or returning and changing goods and the user does not need to wait for the courier to pick up goods at home, thus improving the experience of the user when sending express and returning or changing goods. The structure not only can meet the express storage and retrieval requirement when in use, but also can reduce the occupied space when not in use in a normal state, and has a simple structure.

In some embodiments, as shown in FIG. 1 and FIG. 2, the cover body 2 is provided with a cap body 3, the cap body 3 is arranged on the cover body 2 corresponding to the open end of the container 6, and the cap body 3 is arranged in an openable and closeable manner relative to the cover body 2 for exposing the open end of the container 6 after being opened and closing the open end of the container 6 after being closed. When it is necessary to put the express in the container 6 or take out the article from the container 6, the cap body 3 is directly opened. According to the embodiment, the article is taken and stored more conveniently. Since the cap body 3 is small in volume and easy to open, the open end of the container 6 may be exposed after the cap body 3 is directly opened.

When it is necessary to take and store the article, as shown in FIG. 2, the cover body 2 is in a horizontal state and the container 6 is suspended below the cover body 2, if an opening on the cover body 2 is designed to be rectangular, the cap body 3 may be hinged to any side of the opening as long as the article can be taken out. As shown in FIG. 1, when the cover body 2 is in a closed state, an upper end of the cap body 3 is hinged to the cover body 2 and a lower end of the cap body 3 is opened and closed through rotation relative to the cover body 2, so that the article can be taken and stored more easily. A hinge 32 may be arranged at a hinged position of the cover body 2 and the frame body 1 as well as at a hinged position of the cap body 3 and the cover body 2 for stabilizing rotation.

In order to facilitate opening of the cover body 2 and the cap body 3, as shown in FIG. 1, a first mounting base 21 is arranged at a middle position of the bottom of a front wall of the cover body 2, and a first handle 22 is arranged on the first mounting base 21. Referring to FIG. 2, a concave portion 33 is arranged at a middle position of the bottom of a front wall of the cap body 3 and a second handle 31 is arranged in the concave portion 33, thus preventing the second handle 31 from occupying additional space in a thickness direction of the article storage and retrieval apparatus.

In some embodiments, the article storage and retrieval apparatus according to the present disclosure further includes a first locking component 23 and an identity recognition component. The first locking component 23 is arranged between the cap body 3 and the cover body 2 for locking the cap body 3 relative to the cover body 2. The first locking component 23 has locked and unlocked states. In the case where there is no need to put articles or articles have been put in, the cap body 3 should be in a locked state so as to ensure that the article storage and retrieval apparatus is not used by unrelated persons and ensure the article storage safety.

The identity recognition component is configured to unlock the first locking component 23 to store and retrieve the articles after identity verification information provided by a user (for example: a deliverer or a picker) is verified successfully. After the container 6 is unfolded, the deliverer may store the article; and after the picker takes out the article, the container 6 may be folded, so that the article storage and retrieval apparatus occupies small space, the universality of the article storage and retrieval apparatus can be improved, the article storage and retrieval apparatus is easily popularized and used in different occasions, and the articles may be stored and taken intelligently.

Figure 3:
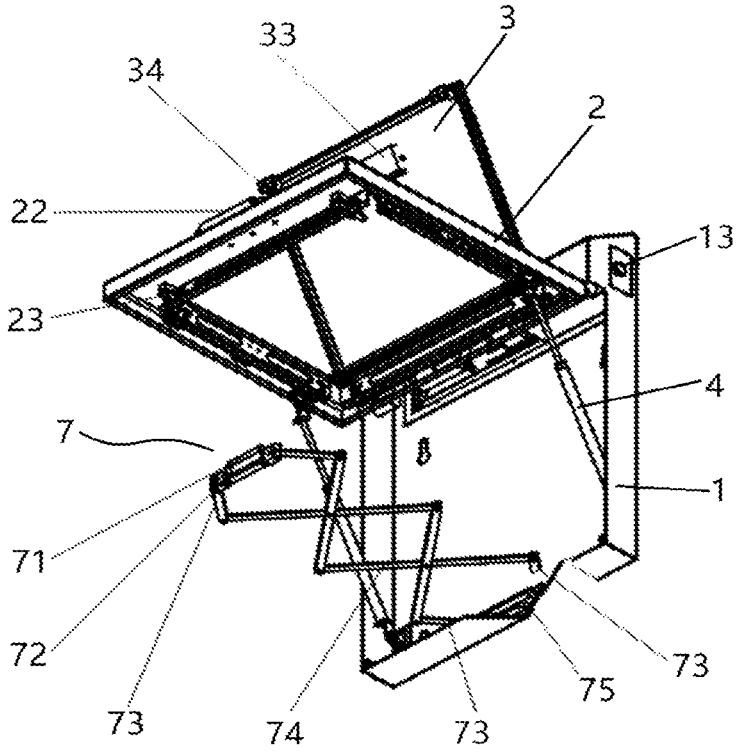
FIG. 3 is a schematic structural diagram of some embodiments of an article storage and retrieval apparatus according to the present disclosure except a container.

In some embodiments, the first locking component 23 is arranged on the back of the cover body 2 and may adopt an electromagnetic lock which acts rapidly. The electromagnetic lock is in a pull-in state under the normal condition. When it is necessary to open the cover body 3, the electromagnetic lock is triggered to be disconnected. Since the disconnection lasts for a short time, in order to prevent the cap body 3 from re-entering the locked state within a short time, a spring mechanism 34 is arranged between the cap body 3 and the cover body 2 for bouncing the cap body 3 off after the first locking component 23 is unlocked, and the bounce-off distance only needs to make the cap body 3 be separated from the original locked position. As shown in FIG. 3, the spring mechanism 34 is arranged at a corner of the back of the cap body 3.

In some embodiments, as shown in FIG. 2, the article storage and retrieval apparatus further includes a magnet 5. The magnet 5 may prevent the cover body 2 from swinging outwards after the cover body 2 is closed, and the cover body 2 may be opened only when an external force applied to the cover body 2 is greater than a suction force of the magnet 5; meanwhile, the magnet 5 may also prevent the cover body 2 from swinging laterally after the cover body 2 is closed. In FIG. 2, the magnet 5 is arranged a corner of an inner side wall of the frame body 1. Furthermore, the magnet 5 may be covered with a rubber layer. The magnet 5 is arranged on the frame body 1 or the cover body 2 for buffering when the cover body 2 is closed so as to prevent the cover body 2 from colliding with the frame body 1 when being closed to avoid big noise and prolong the service life of the article storage and retrieval apparatus.

Optionally, the cover body 2 may be opened or closed freely relative to the frame body 1, or a third locking part may be arranged between the cover body 2 and the frame body 1.

As shown in FIG. 2, in order to suspend the container 6 below the cover body to realize support after the cover body 2 is opened, as shown in FIG. 1, an upper end of the cover body 2 is hinged to the frame body 1 and a lower end of the cover body 2 is opened and closed relative to the frame body 1 through rotation. Optionally, the cover body 2 and the frame body 1 may be hinged at upper end, left end or right end to realize rotary opening and closing.

Specifically, the frame body 1 is fixed on a vertical mounting surface, a front surface of the frame body 1 is of a rectangular structure, a side surface of the frame body 1 is of an inverted L-shaped structure, an area corresponding to a transverse portion of the L-shaped structure is configured to be provided with an electrical component, an upper end of the cover body 2 is hinged to a free end of the transverse portion, the cover body 2 may be buckled on a vertical portion area of the L-shaped structure after rotating downwards to be closed, for example, a front wall of the cover body 2 in flush with a front wall of the transverse portion of the L-shaped structure, thus reducing the occupied space as far as possible. Moreover, an area corresponding to the vertical portion is provided with a cavity, and the container 6 is located in the cavity after being folded.

In order to maintain the cover body 2 at a predetermined position to store articles after the cover body 2 is opened, as shown in FIG. 2 and FIG. 3, the article storage and retrieval apparatus further includes a position retaining part 4. The position retaining part 4 is arranged between the frame body 1 and the cover body 2 and adopts a telescopic structure for maintaining the position of the cover body after the cover body 2 is opened relative to the frame body 1. The positioning retaining piece 4 may be arranged on two sides of the container 6 respectively.

For the flexible container 6, it is not easy to realize positioning retaining through an abutting force of the container 6 on the frame body 1, and the position retaining part 4 may be provided to directly apply an action force to the cover body 2. In addition, the position retaining part 4 may prevent the cover body 2 from swinging sideways in the closing process. According to the embodiments of the present disclosure, the cover body 2 and the frame body 1 may be hinged at upper end, left end or right end, and the position retaining part 4 is arranged at the bottom of the container 6 conveniently, thus realizing bottom support after the article is placed in the container 6 and realizing a more stable article storage state.

In some embodiments, the position retaining part 4 is a nitrogen spring. After the cover body 2 is closed, the nitrogen spring is compressed, and after the cover body 2 is lifted upwards, the nitrogen spring extends correspondingly by the volume expansion of high-pressure nitrogen inside, thereby maintaining the cover body 2 at a preset position. The nitrogen spring has a small volume and is suitable for being used in a narrow space after the cover body 2 is closed; moreover, the nitrogen spring has a large elastic force and long travel and may reliably jack the cover body 2 to a preset height; in addition, the nitrogen spring is gentle in elastic curve and stable in work and may prevent the cover body 2 from colliding with an upper area of the frame body 1 in the lifting process. Alternatively, the position retaining part 4 may also be an electric push rod or a mechanical connecting rod, etc.

In some embodiments, as shown in FIG. 2 and FIG. 3, the article storage and retrieval apparatus further includes a supporting mechanism 7. The supporting mechanism 7 is connected to the frame body 1, and the supporting mechanism 7 has a telescopic structure and may be manually pulled out or pushed back for providing bottom support for a portion for accommodating express in an extended state. For example, the supporting mechanism 7 is arranged in a middle area of the frame body 1 along a horizontal direction.

In some embodiments, the fully extended length of the supporting mechanism 7 may cover the whole front-back dimension of the container 6, thereby increasing a supporting force to the express and preventing the strength of the article storage and retrieval apparatus from being affected by the weight of the express.

As shown in FIG. 3, the supporting mechanism 7 adopts a scissor-shaped structure. One end of the scissor-shaped structure is connected to the frame body 1, for example, connected to a bottom position in the cavity of the frame body 1, and the other end of the scissor-shaped structure is a free end and a force may be applied by the free end to realize extension and retraction. The scissor-shaped structure extends and retracts stably, occupies small height in the front-back direction of the article storage and retrieval apparatus after being folded, and may be suitable for a small space between the cover body 2 and the frame body 1.

Specifically, still referring to FIG. 3, the supporting mechanism 7 of the scissor-shaped structure includes a third handle 71, a second mounting base 72, a first connecting rods 73, a second connecting rods 74 and a fixed base 75. The fixed base 75 is arranged at a bottom position in the cavity of the frame body 1 and extends along a horizontal direction. Each of a left end and a right end of the fixed base 75 is connected to one first connecting rod 73. An end part, close to the outer side, of each first connecting rod 73 is connected to the second connecting rod 74. The two second connecting rods 74 are intersected and hinged at a middle position along a length direction. The group number of the second connecting rods 74 may be arranged as required. The second connecting rods 74 in the outermost group are connected to the first connecting rods 73 respectively, the second mounting base 72 is connected between the two first connecting rods 73, and the third handle 71 is arranged on the second mounting base 72. The first connecting rod 73 is shorter than the second connecting rod 74.

In some embodiments, as shown in FIG. 4, a plurality of first supporting rings 61 and a plurality of second supporting rings 62 are arranged on the flexible container 6. Each first supporting ring 61 and each second supporting ring 62 are alternately arranged at intervals along a height direction of the container 6, and an area surrounded by the first supporting rings 61 is greater than that of the second supporting rings 62. A traction part 63 is connected to each first supporting ring 61 sequentially along the height direction of the container 6, so that wen a free end of the traction part 63 is subjected to an external pulling force, each first supporting ring 61 and each second supporting ring 62 are close to each other in the height direction of the container 6 through movement of the traction part 63 so as to fold the container 6.

For example, in FIG. 4, a cross section of the container 6 is rectangular. In order to uniformly change the thickness of each part of the container 6 in the folding process, one traction part 63 may be arranged at a position close to each of the four corners of the container 6. The traction part 63 may be a rope or a chain, etc.

According to the embodiment, the flexible container 6 may be regularly folded and may be folded to a small volume, so that the occupied space of the container 6 between the cover body 2 and the frame body 1 is reduced. Furthermore, the folding method is simple to operate. When it is necessary to unfold, the container 6 may be unfolded by gravity only by putting the express in the container 6.

Figure 5:
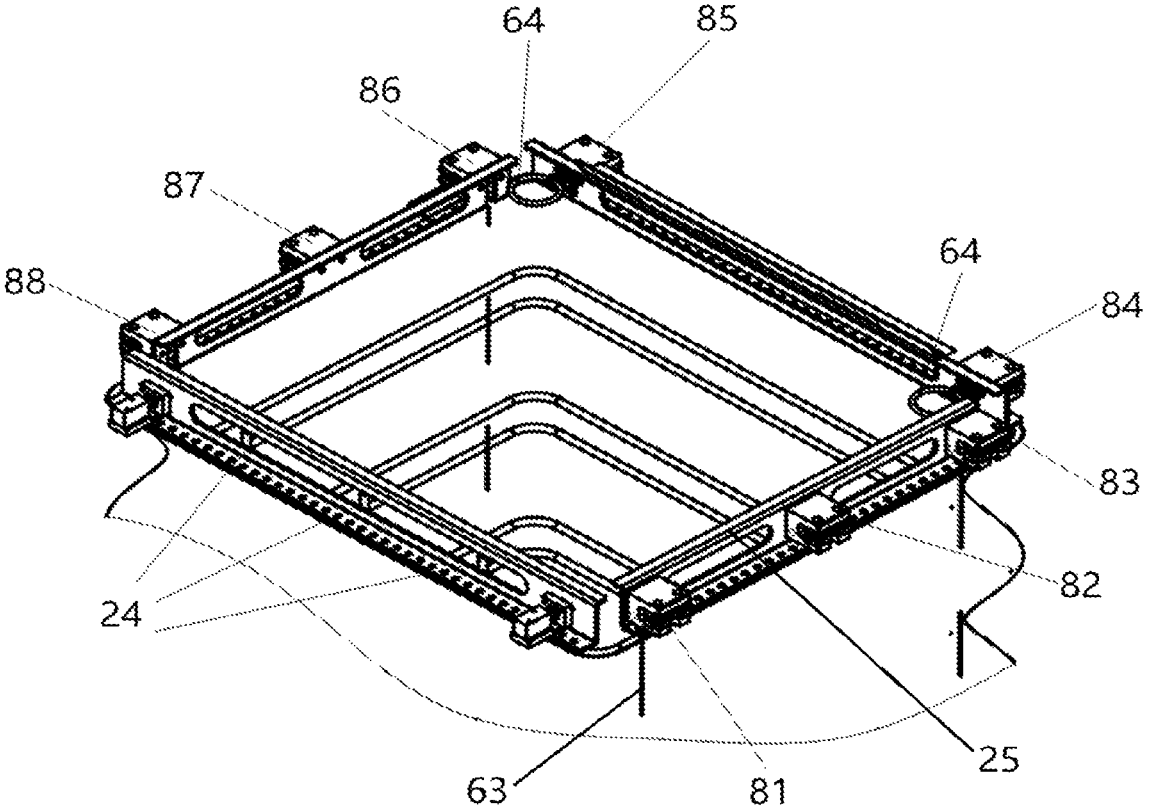
FIG. 5 is a schematic diagram of related structures of connection of a container on a cover body and a traction part in an article storage and retrieval apparatus according to the present disclosure.

In some embodiments, as shown in FIG. 5, a guide component and a fixed part 24 are arranged on the cover body 2, for example: the fixed part 24 may be a fixed column, the traction part 63 is guided by the guide component in the moving process, and the free end of the traction part 63 is connected to the fixed part 24 after the container 6 is folded in place. When it is necessary to unfold the container 6, the free end of the traction part 63 is separated from the fixed pan 24, the article is put into the container 6, and the container 6 can be unfolded. For example, the guide component may be a pulley, a sliding groove or a sleeve pipe, etc.

According to the embodiment, by the guide component, the traction part 63 may still maintain a certain tensioning force in the moving process, thereby improving the controllability when the container 6 is folded.

In a specific embodiment, as shown in FIG. 5, the guide component includes a plurality of pulley blocks, a rectangular mounting frame 25 is arranged in the cover body 2, an open end of the container 6 is connected to the bottom of the mounting frame 25, the plurality of pulley blocks are arranged on an outer side wall of the mounting frame 25 at intervals along a circumferential direction, the fixed part 24 is arranged in an area surrounded by the mounting frame 25, and after the traction part 63 goes around at least part of the pulley blocks, the free end of the traction part 63 can be connected to the fixed part 24 when the container 6 is folded in place.

Specifically, pulley blocks 81, 82 and 83 are arranged on a first side wall of the mounting frame 25. The pulley blocks 81 and 83 are located at positions, close to two ends, of the first side wall respectively, and the pulley block 82 is located at a middle position. Pulley blocks 84 and 85 are arranged on a second side wall, adjacent to the first side wall, of the mounting frame 25. The pulley blocks 84 and 85 are located at positions, close to two ends, of the second side wall respectively. Pulley blocks 86, 87 and 88 are arranged on a third side wall, opposite to the first side wall, of the mounting frame 25. The pulley blocks 86 and 88 are located at positions, close to two ends, of the third side wall respectively, and the pulley block 87 is located at a middle position.

Figure 7:
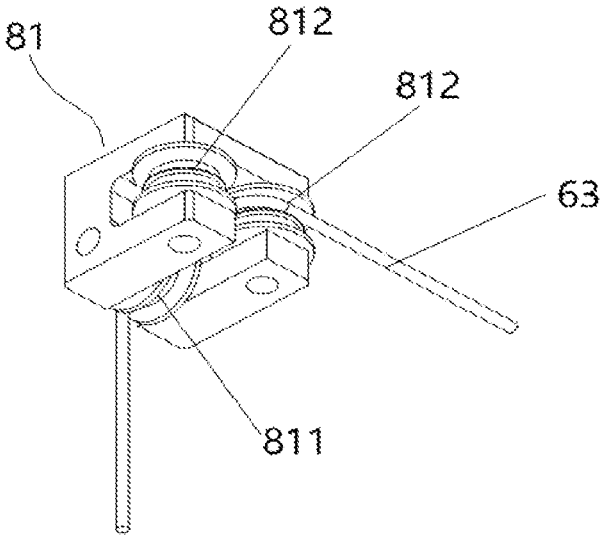
FIG. 7 is a schematic structural diagram of some embodiments of a pulley assembly in an article storage and retrieval apparatus according to the present disclosure.

The pulley blocks 81, 83, 86 and 88 correspond to the positions of the four traction parts 63 respectively. As shown in FIG. 7, the four pulley blocks include a vertical pulley 811 and two horizontal pulley 812 so as to convert the vertically extended traction parts 63 into horizontally extended traction parts 63. Other pulley blocks are only provided with horizontal pulleys.

Based on an azimuth shown in FIG. 5, the traction part 63 located on the outermost side in FIG. 5 sequentially passes through the pulley blocks 81, 82, 83 and 84 and then penetrates through a notch located beside the pulley block 83 on the second side wall of the mounting frame 25; and the fixed pan 24 is arranged on a fourth side wall opposite to the second side wall, and the fixed part 24 may be arranged over against the notch. The traction part 63 penetrating through the notch may be connected to the corresponding fixed part 24 after being pulled by an external force. For the convenience of connection, a pull ring 64 may be arranged at the free end of the traction part 63.

The traction part 63 located on the right side sequentially passes through the pulley blocks 83 and 84 and then penetrates through a notch located beside the pulley block 83 on the second side wall of the mounting frame 25. One fixed part 24 may be connected to the two traction parts 63 on the same side.

The traction part 63 located on the left side sequentially passes through the pulley blocks 88, 87, 86 and 85, then penetrates through a notch located beside the pulley block 85 on the second side wall of the cover body 2, and may be connected to the corresponding fixed part 24.

The traction part 63 located on the back side sequentially passes through the pulley blocks 86 and 85, then penetrates through a notch located beside the pulley block 85 on the second side wall of the mounting frame 25, and may be connected to the corresponding fixed part 24.

Figure 8:
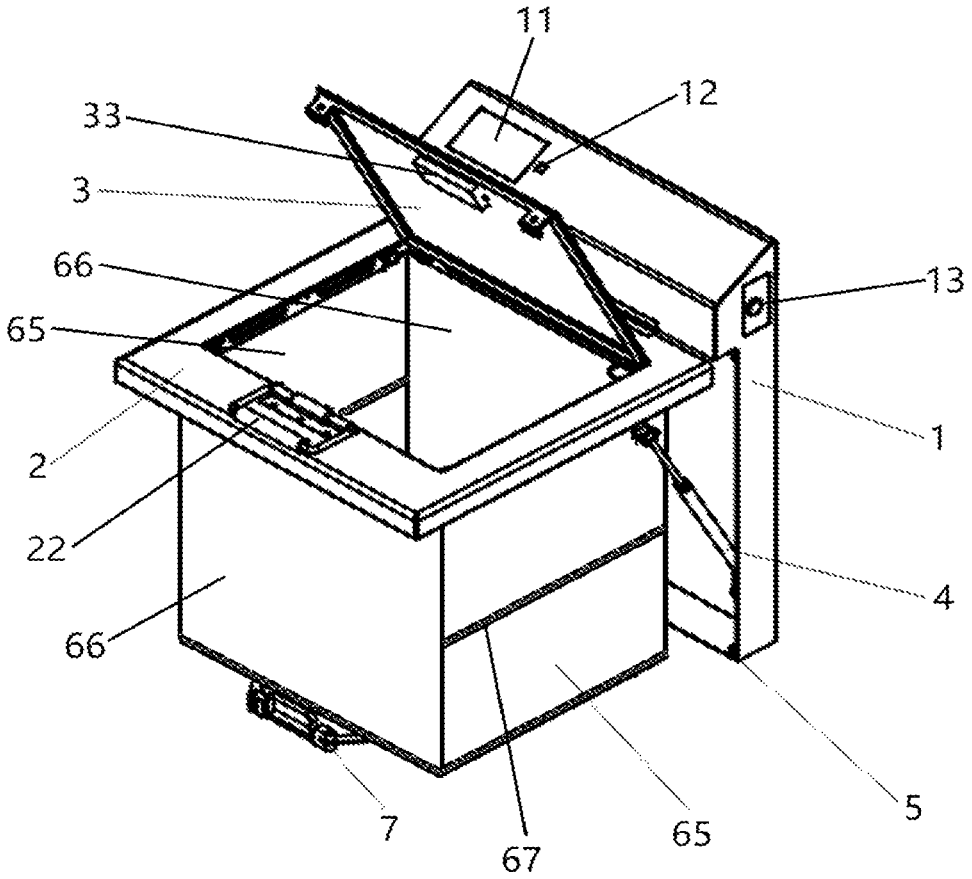
FIG. 8 is a schematic structural diagram of other embodiments of an article storage and retrieval apparatus according to the present disclosure.

In some other embodiments, as shown in FIG. 8, the container 6 is a foldable accommodating box, and the accommodating box includes a plurality of plates. The accommodating box is easy to fold, and the plates are stuck together after the accommodating box is folded, so that the occupied volume is small, and miniaturization of the article storage and retrieval apparatus may be realized maximally.

Still referring to FIG. 8, the plurality of plates may include: two first plates 65, a second plate and two third plates 66. The two first plates 65 are arranged oppositely, and a first end of each of the two first plates 65 is connected to an inner side of the cover body 2. The second plate is located between the two first plates 65 and is connected to second ends, away from the cover body 2, of the two first plates 65. The second plate is a bottom plate in FIG. 8 and is not shown due to a shielding relationship. A first end of each of the two third plates 66 is connected to two opposite ends of the second plate. A second end of each of the two third plates 66 can be turned over to realize unfolding or folding of the accommodating box. A second locking component may be arranged between the second end of each of the two third plates 66 and the cover body 2, not shown in the figure. The two third plates 66 are respectively a front plate and a back plate in FIG. 8.

An opening of the accommodating box is surrounded by the first end of each of the two first plates 65 and the second end of each of the third plates 66, each of the two first plate 65 is provided with a folding line 67 extending parallel to the second plate at a middle position vertical to the second plate, and a connection position of the adjacent plates is also provided with the folding line 67.

When it is necessary to put the article, the cover body 2 is turned upwards until in a horizontal state. In the opening process of the cover body 2, each plate in the accommodating box in a folded state before falls and is unfolded under the action of self weight and applies a downward action force to the first plate 65 or the second plate until the second plate falls to the lowest position, so that the first plate 65 forms a vertical flat plate state. The back third plate 66 is turned upwards to lock the second end of the third plate 66 and the cover body 2, and the article may be put in at this time. Then, the front third plate 66 is turned upwards to lock the second end of the third plate 66 and the cover body 2, and finally, the cap body 3 is closed, so that the accommodating box is in a locked state.

When it is necessary to take out the article, the cap body 3 is unlocked and opened, the two ends of the two third plates 66 are unlocked after the article is taken out, the back third plate 66 may be folded to be attached to the top of the second plate, and the front third plate 66 may be folded to be attached to the bottom of the second plate; then the second plate is pushed upwards to make the whole accommodating box in a folded state; and finally, the cap body 3 is closed and the cover body 2 is put down.

In some embodiments, the third plate 66 is configured to form a delivery opening between the third plate 66 and the cover body 2 after the accommodating box is unfolded for putting small articles after the accommodating box is locked. For example, a long strip-shaped delivery opening is formed between the third plate 66 and the cover body 2, so that envelopes or soft package expresses may be put in when the accommodating box is locked. In other embodiments, a delivery opening may be directly formed in a main body surface of each plate on the accommodating box.

In some embodiments, a limiting plate is arranged on end parts, adjacent to the two first plates 61, of the third plate 66, and the limiting plate can cover an outer side of the first plate 61 after the accommodating box is unfolded. The limiting plate may be arranged vertical to the third plate 66, for example, a limiting plate with an overall structure may be arranged on the end parts, adjacent to the first plates 61, of the third plate 66 along a height direction of the first plates 61, or a plurality of limiting plates are arranged at intervals along the height direction of the first plates 61.

According to the embodiment, by the limiting plate, a middle part of a side plate (such as a first plate 65) of the accommodating box may be prevented from being opened outwards at a folded part, thus improving the firmness of the overall structure of the accommodating box, avoiding damage to the accommodating box and ensuring the article storage safety.

In some embodiments, an extending plate is arranged on an end part, adjacent to the third plate 66, of the first plate 61 and the limiting plate is provided with an opening. When the accommodating box is unfolded, the limiting plate covers an outer side of the first plate 61 and the extending plate is inserted into the opening. The limiting plate and the extending plate form an intersected structure and may form bidirectional fixation, so that the overall structure strength of the accommodating box can be further improved.

In some embodiments, the article storage and retrieval apparatus further includes a controller. The controller is configured to, in response to an external trigger signal, control at least one of the following actions: opening and closing of the cover body 2 relative to the frame body 1, opening and closing of the cap body 3 relative to the cover body 2, extension and retraction of the supporting mechanism 7 and folding of a part for accommodating the express.

The electrically controlled article storage and retrieval apparatus can further improve the use convenience and enhance the storage and retrieval efficiency of the express. For the function requiring electric control, a button may be correspondingly arranged on the frame body 1 in a fixed state for each function. When it is necessary to perform a certain function, the corresponding button may be triggered by an operator; or only one button may be provided, and each function requiring electric control may be performed in a linkage manner after the button is triggered.

Figure 6:
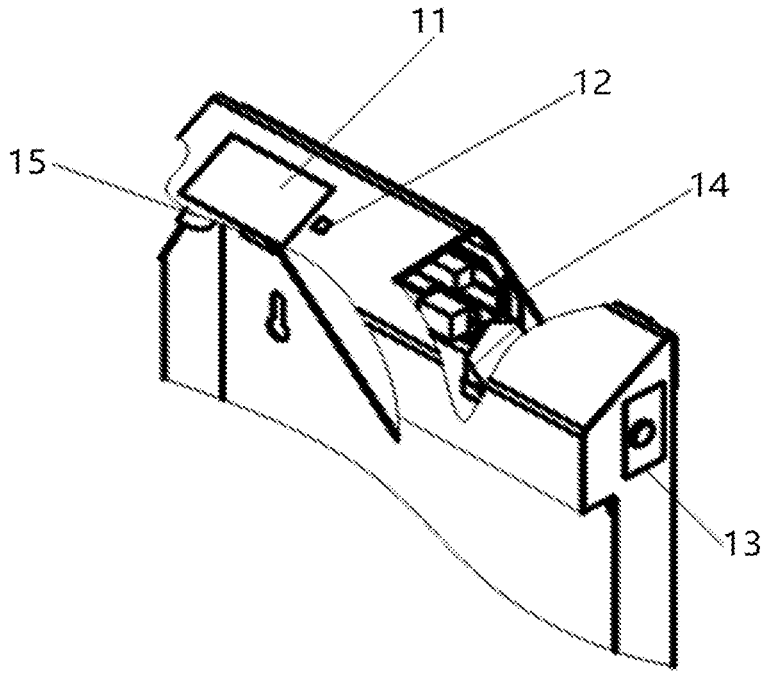
FIG. 6 is a structural diagram of electrical arrangement in an article storage and retrieval apparatus according to the present disclosure.

In some embodiments, as shown in FIG. 6, the top of the frame body 1 is set as a surface inclining forwards, and a touch screen 11, a camera 12 and a switch 15 may be arranged at the top of the frame body 1. The touch screen 11 may display information or receive identify recognition of a user, the camera 12 may provide face recognition, and the switch 15 may be configured to start an electrical system of the article storage and retrieval apparatus. As mentioned above, the frame body 1 may be set as an L-shaped structure, a control panel assembly 14 is arranged in a transverse portion of the L-shaped structure, a controller may be mounted in the control panel assembly, preassembling is conducted before overall assembling, and mounting and maintenance are facilitated by an overall mounting form. A power supply assembly 13 may be mounted on a side wall of the frame body 1, and the power supply assembly 13 adopts a drawer form. If the power supply is insufficient and cannot supply power, a power supply door may be opened by a key, and the power supply assembly 13 is taken out for charging.

The identity recognition component mentioned in the above embodiment may adopt various structure forms, for example, identity verification may be conducted through code scanning, face recognition, sound recognition, fingerprint recognition, verification code check and the like, and the electronic locking part is unlocked after identity is verified successfully. Or remote control unlocking may be conducted on a mobile terminal APP through a wifi module and/or a Bluetooth module.

By taking the case where the courier needs to deliver the express and the user takes out the express as an example, the use method of the article storage and retrieval apparatus with the structure is described below with reference to FIG. 1 to FIG. 5.

(1) The courier unlocks the article storage and retrieval apparatus:

when the courier, as a deliverer, needs to put the express in the article storage and retrieval apparatus, a third-party platform such as e-commerce or express and the like will match the article storage and retrieval apparatus according to the order information of the current express and open the authority for the courier to open the article storage and retrieval apparatus, for example, the third-party platform will transmit a verification code, a graphic code and the like for opening the article storage and retrieval apparatus to the courier, or may bind personal identity information (such as fingerprint, face, sound and the like) of the courier with the verification information of the article storage and retrieval apparatus, so that the courier may unlock the first locking component 23 through identity verification.

(2) The courier opens the article storage and retrieval apparatus and puts the express into the device:

the courier opens the cover body 2 upwards until the cover body 2 is in a horizontal state; and in the opening process of the cover body 2, the position retaining part 4 provides position support for the cover body 2 and the cap body 3 is closed. As shown in FIG. 5, the pull rings 64 on two sides are separated from the fixed part 24, the express is put into the container 6, and the container 6 is automatically unfolded under the gravity action of the express to form a storage space with a first volume. Then, the courier closes the cap body 3, and the first locking component 23 locks the container 6 at this time.

(3) The user unlocks the article storage and retrieval apparatus:

The identity verification information of the user may be acquired by the following ways:

The user who has performed identity information association with the article storage and retrieval apparatus may directly own the identity verification information of the article storage and retrieval apparatus, for example, preset password for opening the article storage and retrieval apparatus, entered fingerprint, face or sound information.

If the express needs to betaken by someone else, the courier may transmit a package retrieval code to the mobile terminal of the user after putting the express, and the user who has known the package retrieval code may unlock the article storage and retrieval apparatus by verifying the package retrieval code.

If the express needs to be taken by someone else, the courier may transmit information that the express has been stored to the third-party platform through the mobile terminal after putting the express, the third-party platform may transmit a package retrieval code to the mobile terminal of the user, and the user who has known the package retrieval code may unlock the article storage and retrieval apparatus by verifying the package retrieval code.

(4) The user opens the article storage and retrieval apparatus and takes out the express:

the user opens the cap body 3 and takes out the express. A force is applied to the pull ring 64 on two sides, the container 6 is folded by moving the pull rings 64, and the pull rings 64 sleeve the fixed part 24 on the corresponding side after folding is completed. Then the cap body 3 is closed and the cover body 2 is put down.

Similarly, the article storage and retrieval apparatus according to the present disclosure may be applied to the situation that the courier needs to pick up the goods when the user sends or turns and changes goods, different from the above usage scenario, when the user needs to put the express, the user who has performed identity information association with the article storage and retrieval apparatus may directly own the identity verification information of the article storage and retrieval apparatus and may tell the identity verification information to others if asking others to take the express.

Then, after the user stores the express, the user needs to inform the third-party platform that goods need to be sent or returned and hopes the courier to pick up the goods at home, and the third-party platform will arrange a suitable courier to pick up the goods and transmit the identity verification information to the courier who is going to take the goods, so that the arrangement flexibility of the package retrieval business can be improved; or if the user has a familiar courier, the user may directly transmit the package retrieval code to the courier.

Secondly, the present disclosure further provides a working method of the article storage and retrieval apparatus based on the above embodiments. In some embodiments, the working method includes the following steps:

the identity recognition component verifies identity verification information provided by a deliverer or a picker;

after the information is verified successfully, the first locking component 23 is unlocked to change the volume of the container 6.

In some specific embodiments, the working method of the present disclosure includes:

an identity recognition component verifies identity verification information by a deliverer;

after the information is verified successfully, the first locking component 23 is unlocked, so that the deliverer unfolds the container 6 to put the express;

then, the identity recognition component verifies the identity verification information provided by the deliverer;

after the information is verified successfully, the first locking component 23 is unlocked, so that the picker folds the container 6 after retrieving the express.

For the previous embodiment, when the courier needs to deliver the express and the user needs to take the express, identity verification information provided by the courier as a deliverer is from the third-party platform, the third-party platform matches the article storage and retrieval apparatus according to the information of the express to be delivered and gives the authority to the corresponding courier to open the article storage and retrieval apparatus and store the express. The identity verification information provided by the user as a picker is from: the identity verification information which is set to perform identity association with the article storage and retrieval apparatus in advance, the courier transmits the package retrieval code to the user after putting the express, or the courier transmits the information that the express has been stored to the third-party platform and the third-party platform transmits the package retrieval code to the user.

When the user needs to send the express and the courier needs to take the express, the identity verification information provided by the user as a deliverer is from the verification information which is set to perform identity association with the article storage and retrieval apparatus in advance. The identity verification information provided by the courier as a picker is from: the user directly transmits the package retrieval code to the courier, or the user informs the third-party platform after storing the express and the third-party platform gives the authority to the corresponding courier to open the article storage and retrieval apparatus and take the express.

The article storage and retrieval apparatus according to the present disclosure is introduced above in detail. The principle and embodiments of the present disclosure are elaborated by specific embodiments, and the description of the above embodiments is only intended to help understand the method of the present disclosure and the core concept thereof. It should be noted that those skilled in the art may also make several improvements and modifications without departing from the principles of the present disclosure which should fall within the protection scope of the claims of the present disclosure.

What is claimed is:

1. An article storage and retrieval apparatus, comprising:

a frame body, configured to be fixed on a vertical mounting surface;

a cover body, hinged with the frame body at upper end, left end or right end to rotate to open and close;

a container, an opening of the container being arranged on an inner side of the cover body, and the container being located in a space formed between the frame body and the cover body, wherein the container has a variable volume and is configured to be unfolded to form a space for accommodating articles after the cover body is opened relative to the frame body, and allow the cover body to be closed relative to the frame body after being folded; and a cap body, arranged on the cover body corresponding to the opening of the container; and the cap body is arranged in an openable and closeable manner relative to the cover body to expose the opening of the container after being opened and close the opening of the container after being closed.

2. The article storage and retrieval apparatus according to claim 1, wherein when the cover body is closed, an upper end of the cap body is hinged to the cover body, and a lower end of the cap body is openable and closeable through rotation relative to the cover body.

3. The article storage and retrieval apparatus according to claim 1, further comprising:

a first locking component, arranged between the cap body and the cover body to lock the cap body relative to the cover body; and an identity recognition component, configured to unlock the first locking component after identity verification information provided by a user is verified successfully.

4. The article storage and retrieval apparatus according to claim 3, wherein a spring mechanism is arranged between the cap body and the cover body to bounce the cap body off after the first locking component is unlocked.

5. The article storage and retrieval apparatus according to claim 1, further comprising:

a supporting mechanism, adopting a telescopic structure, wherein the supporting mechanism is connected to the frame body to extend out after the container is unfolded to provide support for the bottom of the container.

6. The article storage and retrieval apparatus according to claim 5, wherein the supporting mechanism adopts a scissor-shaped structure; and one end of the scissor-shaped structure is connected to a bottom area of the frame body, the other end of the scissor-shaped structure is a free end.

7. The article storage and retrieval apparatus according to claim 1, further comprising:

a position retaining part, arranged between the frame body and the cover body and adopting a telescopic structure to retain a position of the cover body after the cover body is opened relative to the frame body.

8. The article storage and retrieval apparatus according to claim 7, wherein the position retaining part is a nitrogen spring.

9. The article storage and retrieval apparatus according to claim 1, wherein one side, facing the cover body, of the frame body is provided with a cavity, and the container is located in the cavity after being folded.

10. The article storage and retrieval apparatus according to claim 1, further comprising a magnet, wherein the magnet is arranged on the frame body or the cover body to prevent the cover body from swinging outwards after the cover body is closed, and the magnet is covered with a rubber layer for buffering when the cover body is closed.

11. The article storage and retrieval apparatus according to claim 1, wherein the container is a flexible container.

12. The article storage and retrieval apparatus according to claim 11, wherein a plurality of first supporting rings and a plurality of second supporting rings are arranged on the container, the plurality of first supporting rings and the plurality of second supporting rings are alternately arranged at intervals along a height direction of the container, and an area surrounded by the first supporting rings is greater than that of the second supporting rings; and the article storage and retrieval apparatus further comprises a traction part, and the traction part is connected to the plurality of first supporting rings sequentially along the height direction of the container, so as to move to fold the container when a free end of the traction part is subjected to an external pulling force.

13. The article storage and retrieval apparatus according to claim 12, wherein a guide component and a fixed part are arranged on the cover body, the traction part is guided by the guide component in the moving process, and the free end of the traction part can be connected to the fixed part after the container is folded in place.

14. The article storage and retrieval apparatus according to claim 13, wherein the guide component comprises a plurality of pulley blocks, a mounting frame is arranged in the cover body, the open end of the container is connected to the mounting frame, the plurality of pulley blocks are arranged on an outer side wall of the mounting frame at intervals along a circumferential direction, the fixed part is arranged in an area surrounded by the mounting frame, and after the traction part goes around at least part of the pulley blocks, the free end of the traction part can be connected to the fixed part when the container is folded in place.

15. The article storage and retrieval apparatus according to claim 1, wherein the container is a foldable accommodating box, and the accommodating box comprises a plurality of plates.

16. The article storage and retrieval apparatus according to claim 15, wherein the plurality of plates comprise:

two first plates, arranged oppositely, and a first end of each of the two first plates being connected to the cover body;

a second plate, located between the two first plates and connected to a second end, away from the cover body, of each of the two first plates; and two third plates, a first end of each of the two third plates being respectively connected to two opposite ends of the second plate, a second end of each of the third plates being able to turn over relative to the second plate to unfold or fold the accommodating box, and a second locking component being arranged between the second end of each of the two third plates and the cover body;

wherein the opening of the accommodating box is surrounded by the first end of each of the two first plates and the second end of each of the two third plates, each of the two first plate is provided with a folding line extending parallel to the second plate at a middle position vertical to the second plate, and a connection position of the adjacent plates is also provided with the folding line.

17. The article storage and retrieval apparatus according to claim 1, further comprising a supporting mechanism, adopting a telescopic structure and arranged in the frame body to extend out to after the container is unfolded to provide support for the bottom of the container, and the article storage and retrieval apparatus further comprising a controller, configured to, in response to an external trigger signal, execute at least one of the following actions: opening and closing of the cover body, opening and closing of the cap body, extension and retraction of the supporting mechanism and folding of the container.

18. The article storage and retrieval apparatus according to claim 1, wherein the article storage and retrieval apparatus is an express box.

* * * * *